US007071606B2

(12) United States Patent
Wada et al.

(10) Patent No.: US 7,071,606 B2
(45) Date of Patent: Jul. 4, 2006

(54) COLOR PICTURE TUBE

(75) Inventors: Yasufumi Wada, Takatsuki (JP); Toshihiro Daimon, Katano (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 58 days.

(21) Appl. No.: 10/470,371

(22) PCT Filed: Apr. 3, 2002

(86) PCT No.: PCT/JP02/03319

§ 371 (c)(1),
(2), (4) Date: Jul. 25, 2003

(87) PCT Pub. No.: WO02/084694

PCT Pub. Date: Oct. 24, 2002

(65) Prior Publication Data

US 2004/0113534 A1 Jun. 17, 2004

(30) Foreign Application Priority Data

Apr. 6, 2001 (JP) ..... 2001-108177

(51) Int. Cl.
*H01J 29/50* (2006.01)
*H01J 29/74* (2006.01)
*H01J 29/70* (2006.01)

(52) U.S. Cl. ..... 313/412; 313/434; 313/437; 313/439

(58) Field of Classification Search ..... 313/412, 313/434, 437, 439
See application file for complete search history.

(56) References Cited

U.S. PATENT DOCUMENTS

| | | | | |
|---|---|---|---|---|
| 4,814,670 | A | 3/1989 | Suzuki et al. | |
| 5,061,881 | A | 10/1991 | Suzuki et al. | |
| 5,367,230 | A * | 11/1994 | Iguchi et al. | 315/368.15 |
| 5,539,285 | A * | 7/1996 | Iguchi et al. | 315/382 |
| 5,663,609 | A * | 9/1997 | Kamohara et al. | 313/412 |
| 5,694,004 | A * | 12/1997 | Kimiya et al. | 315/15 |
| 5,994,826 | A | 11/1999 | Ueno et al. | 313/413 |
| 6,339,293 | B1 * | 1/2002 | Kimiya et al. | 315/15 |

FOREIGN PATENT DOCUMENTS

| | | | | |
|---|---|---|---|---|
| EP | 0 856 869 | | 8/1998 | |
| JP | 47-22210 | | 7/1972 | |
| JP | 61-99249 | | 5/1986 | |
| JP | 3-93135 | | 4/1991 | |
| JP | 5-135708 | | 6/1993 | |
| JP | 6-236738 | | 8/1994 | |
| JP | 06-236738 | * | 8/1994 | 313/412 |
| JP | 7-147129 | | 6/1995 | |
| JP | 8-212947 | | 8/1996 | |
| JP | 10-289671 | | 10/1998 | |

(Continued)

*Primary Examiner*—Mariceli Santiago
*Assistant Examiner*—Elizabeth Rielley
(74) *Attorney, Agent, or Firm*—Hamre, Schumann, Mueller & Larson, P.C.

(57) ABSTRACT

A color picture tube in which an electron gun emits three electron beams arranged in line, in which the diameter of the spot (26) at the center of the screen in the in-line direction is smaller than that in the direction perpendicular to the in-line direction when the spot is in a just-focused state. Therefore the shape of the spot (27) at the periphery of the screen is generally a true circle. As a result, the resolution at the periphery of the phosphor screen is improved, and the more is suppressed.

9 Claims, 7 Drawing Sheets

FOREIGN PATENT DOCUMENTS

| | | |
|---|---|---|
| JP | 11-31464 | 2/1999 |
| JP | 11-167880 | 6/1999 |
| KR | 1994-16418 | 7/1994 |
| KR | 1998-71181 | 10/1998 |

* cited by examiner

COLOR PICTURE TUBE

TECHNICAL FIELD

The present invention relates to a color picture tube used in a television receiver, a computer monitor or the like. In particular, the present invention relates to a color picture tube that can obtain a high quality image even with a wide deflection angle.

BACKGROUND ART

In a general color picture tube, as shown in FIG. 5, an envelope includes a panel 2 having a face portion 1 whose front surface is substantially rectangular, and a funnel 3 joined to this panel 2. An inner surface of the face portion 1 is provided with a phosphor screen 4, and a shadow mask 5 is held so as to face this phosphor screen 4. Further, inside a neck portion 6 of the funnel 3, an electron gun 7 is provided. During the operation of such a color picture tube, three electron beams 8 arranged in an in-line manner are emitted from the electron gun 7, pass through apertures of the shadow mask 5 while being deflected by a magnetic field generated by a deflection device 9, which is attached to an outside of the funnel 3, and then are irradiated on the phosphor screen 4 so as to produce an image on the face portion 1.

In order to achieve a self-convergence configuration for converging the three electron beams to one point on the screen, the deflection magnetic field generated by the deflection device generally is distorted into a pincushion shape at the time of deflection in an in-line direction (in the following, referred to as a horizontal direction because this direction generally corresponds to a horizontal axis of the screen) and a barrel shape at the time of deflection in a direction perpendicular to the in-line direction (in the following, referred to as a vertical direction because this direction generally corresponds to a vertical axis of the screen). Therefore, the deflection magnetic field exerts a lens effect including a diverging effect in the horizontal direction and a converging effect in the vertical direction on the three electron beams passing through this deflection magnetic field. Since the deflection magnetic field intensifies in keeping with the amount of deflection, the above-mentioned lens effect increases toward a peripheral portion of the screen. Thus, even when a beam spot formed in a central portion of the screen is made into a perfect circle, beam spots formed in the peripheral (particularly, corner) portion of the screen are distorted to have a horizontally elongated shape. Moreover, over-focusing occurs in the vertical direction, so that a vertically-elongated low-brightness haze portion tends to be formed.

JP 61(1986)-99249 A discloses a technology for alleviating such over-focusing (referred to as a "first conventional technology"). FIGS. 6A and 6B show cross-sections, taken along a deflection direction, of a model in which an electron lens system generated by the difference in electric potential between electrodes in an electron gun in the first conventional technology is illustrated as in an optical lens and of paths of electron beams passing through this electron lens system, with the upper half showing a horizontal direction (H) and the lower half showing a vertical direction (V). FIGS. 6A and 6B show the electron lens system and paths 10 of the electron beams passing therethrough respectively in the central portion of the screen and the peripheral (corner) portion of the screen. Further, the left end of the figure indicates a crossover point of the electron beams corresponding to an object point of a lens system, while the right end thereof indicates a spot point on the screen corresponding to an image point of the lens system. An outgoing angle from the crossover point is expressed by $\theta o$, while an incident angle to the screen is expressed by $\theta i$.

As shown in FIG. 6A, in the central portion of the screen, the electron beams are focused by a main lens 11 alone. On the other hand, as shown in FIG. 6B, in the peripheral portion of the screen, a dynamic focus voltage according to an increase in the deflection angle is applied, thereby forming a four-pole lens 12 having a converging effect in the horizontal direction and a diverging effect in the vertical direction at a foregoing stage of the main lens 11 and weakening the main lens 11. The effect of the four-pole lens 12 cancels out the effect of a deflection magnetic field lens 13 by the deflection magnetic field, which intensifies toward the peripheral portion of the screen, and weakening the main lens 11 compensates for the difference in distance between the central portion and the peripheral portion of the screen, so that the electron beams come into just focus over the entire screen.

However, in the first conventional technology, although the electron beams can be maintained to achieve just focus both in the horizontal direction and the vertical direction, the electron beams have a large difference between an incident angle $\theta ih$ to the screen in the horizontal direction and an incident angle $\theta iv$ to the screen in the vertical direction. In general, a magnification M of a lens system has a relationship of $M \propto (\tan\theta o)/(\tan\theta i)$ where $\theta o$ is the outgoing angle from the object point to the lens system and $\theta i$ is the incident angle from the lens system to the image point. Accordingly, (incident angle $\theta iv$ to the screen in the vertical direction)> (incident angle $\theta ih$ to the screen in the horizontal direction) as in the first conventional technology illustrated in FIG. 6B results in (lens magnification Mv in the vertical direction) <(lens magnification Mh in the horizontal direction). In other words, since the lens magnification in the horizontal direction is larger than that in the vertical direction, the spot is distorted into a horizontally-elongated shape, causing a problem in that a horizontal dimension of the spot becomes so large as to lower a horizontal resolution and a vertical dimension of the spot becomes so small as to generate a moiré phenomenon.

A technology for solving such a problem is disclosed in JP 3(1991)-93135 A (referred to as a "second conventional technology").

FIGS. 7A and 7B show a lens system and paths of electron beams according to the second conventional technology, as in FIGS. 6A and 6B. The central portion of the screen (see FIG. 7A) is similar to the first conventional technology (FIG. 6A), while in the peripheral (corner) portion of the screen (see FIG. 7B), a second four-pole lens 14 having a diverging effect in the horizontal direction and a converging effect in the vertical direction is formed further at the foregoing stage of the four-pole lens 12 formed in the first conventional technology. This second four-pole lens 14 allows the electron beams to diverge outward in the horizontal direction and converge inward in the vertical direction before reaching the main lens 11. As a result, the difference between the incident angle $\theta iv$ to the screen in the vertical direction and the incident angle $\theta ih$ to the screen in the horizontal direction is reduced (in other words, the lens magnification in the horizontal direction and that in the vertical direction are made substantially equal in the peripheral portion of the screen). This makes it possible to bring the spot shape in the peripheral portion of the screen closer to a perfect circle, thereby both enhancing a horizontal resolution and suppressing the generation of moiré.

However, even in this second conventions technology, when the deflection angle increases excessively, there has been a problem that it becomes difficult to bring the spot shape in the peripheral portion of the screen closer to a perfect circle.

First, there is a problem that the horizontally elongated spot distortion in the peripheral portion of the phosphor screen cannot be corrected sufficiently due to an influence of a spherical aberration of the main lens. The reason follows. In the second conventional technology, when attempting to alleviate the horizontally-elongated spot distortion in the peripheral portion of the screen, the electron beams passing through the lens system travel close to an edge of the main lens 11, especially in the horizontal direction as shown in FIG. 7B. This phenomenon becomes noticeable as the deflection angle increases, i.e., the magnetic field intensifies. In this case, even when the electron beams ideally achieve the just focus as indicated by solid lines, they actually are affected by the spherical aberration that is noticeable at the edge of the main lens 11, so that the electron beams reaching the screen follow a path as indicated by a broken line and then are over-focused. As a result, the beam spots formed in the peripheral portion of the screen further are distorted into a horizontally-elongated shape, so that the spot dimension thereof tends to become too large.

In order to avoid the above, if attempting to bring the electron beam passing position in the main lens 11 in the horizontal direction as far inwardly as possible, the second four-pole lens 14 that serves to diverge the electron beams outward in the horizontal direction and converge them inward in the vertical direction becomes useless.

In other words, the conventional technologies have had a problem that, when the deflection angle increases excessively and the deflection magnetic field intensifies too much, the horizontally elongated spot distortion in the peripheral portion cannot be corrected sufficiently.

DISCLOSURE OF INVENTION

It is an object of the present invention to provide a color picture tube that can reduce a horizontally-elongated spot distortion in a peripheral portion of a screen even with an increased deflection angle.

In order to achieve the above-mentioned object, a color picture tube of the present invention provides a color picture tube, with three electron beams arranged in an in-line manner being emitted from an electron gun. When a spot formed in a central portion of a screen is just in focus, the spot in the central portion of the screen has a dimension along the in-line direction smaller than that along a direction perpendicular to the in-line direction.

This makes it possible to bring a spot shape in a peripheral portion of the screen closer to a perfect circle easily. As a result, a display resolution of the color picture tube can be enhanced, and the generation of moiré can be suppressed, thereby obtaining a high quality image.

In the above-described color picture tube of the present invention, it is preferable that a main lens portion formed in the electron gun has a lens magnification along the in-line direction smaller than that along the direction perpendicular to the in-line direction. Here, the "main lens portion" refers to an entire electron lens system formed between a crossover point of the electron beams and a spot point on the screen.

This makes it possible to vertically-elongate a spot shape in the central portion of the screen.

Furthermore, in the color picture tube of the present invention, it is preferable that the electron beams reaching the central portion of the screen have an incident angle to the screen along the in-line direction larger than that along the direction perpendicular to the in-line direction. Alternatively, it is preferable that an electron beam emitting region of a cathode in the electron gun has a dimension along the in-line direction smaller than that along the direction perpendicular to the in-line direction.

This makes it possible to vertically-elongate the spot shape in the central portion of the screen easily.

BEST MODE FOR CARRYING OUT THE INVENTION

The following is a description of an embodiment of the present invention, with reference to the accompanying drawings.

Figure 5:
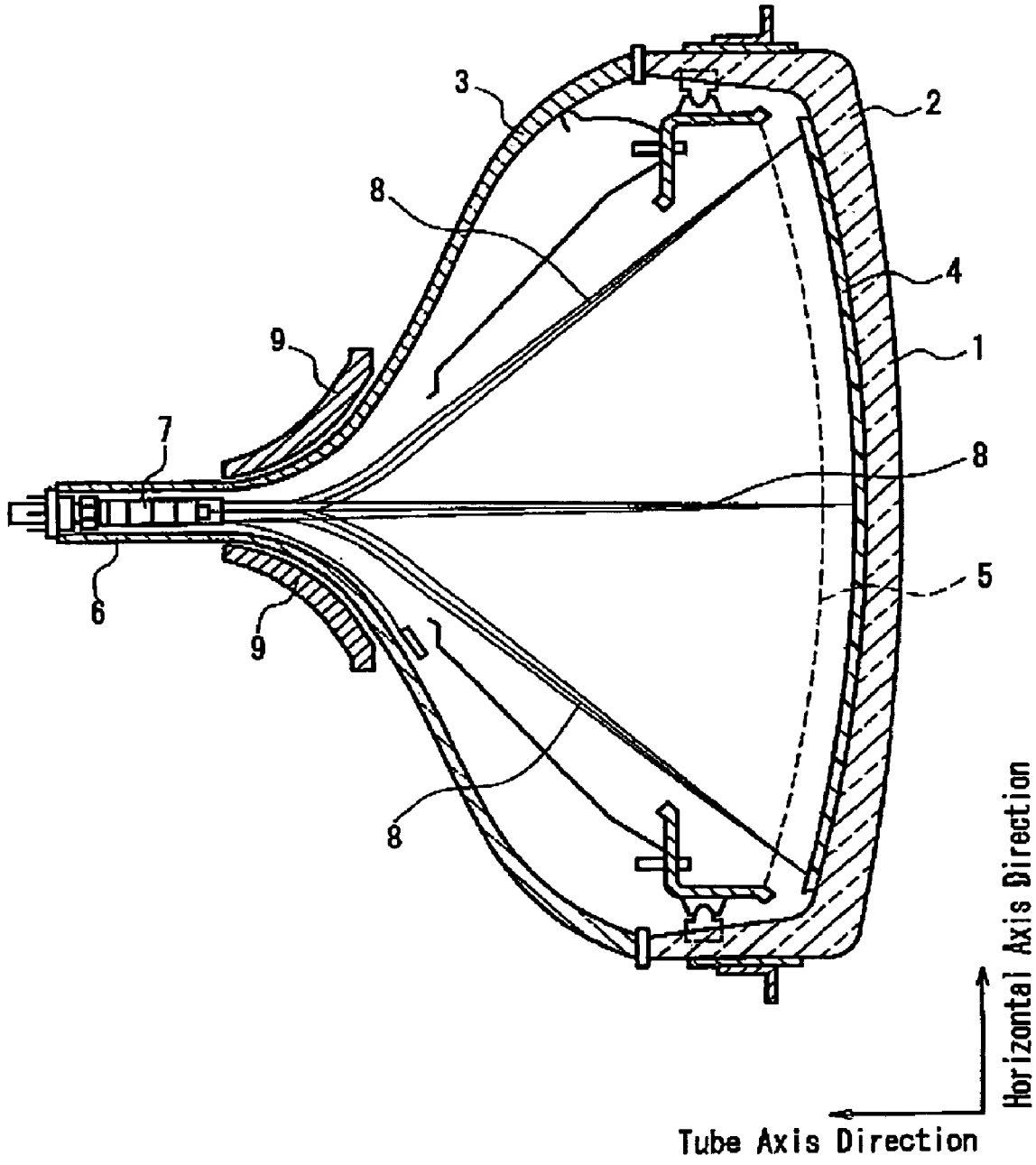
FIG. 5 Prior Art
FIG. 5 is a cross-sectional view showing a schematic configuration of a general color picture tube.
Figure 6A:
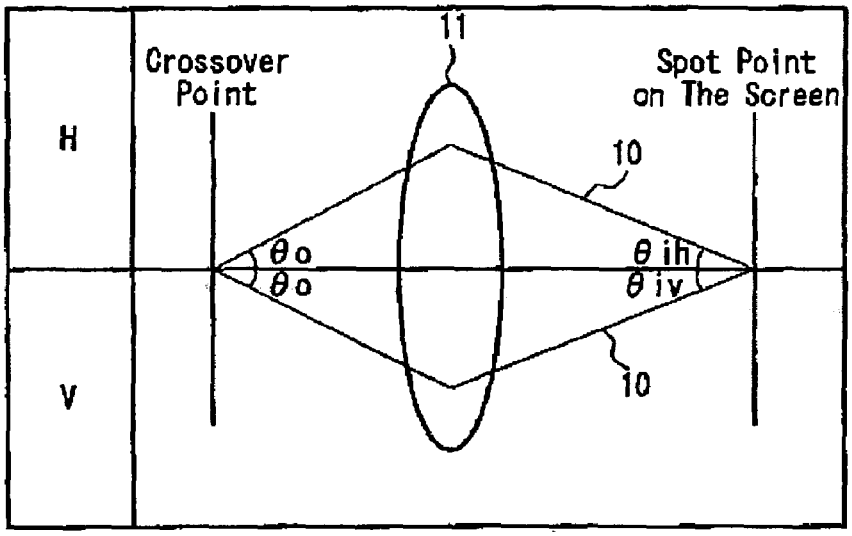
FIG. 6A Prior Art
FIG. 6A shows a model in which an electron lens system in an electron gun in a central portion of a screen is illustrated as in an optical lens and paths of electron beams passing through this electron lens system, in a color picture tube according to a first conventional technology.
Figure 6B:
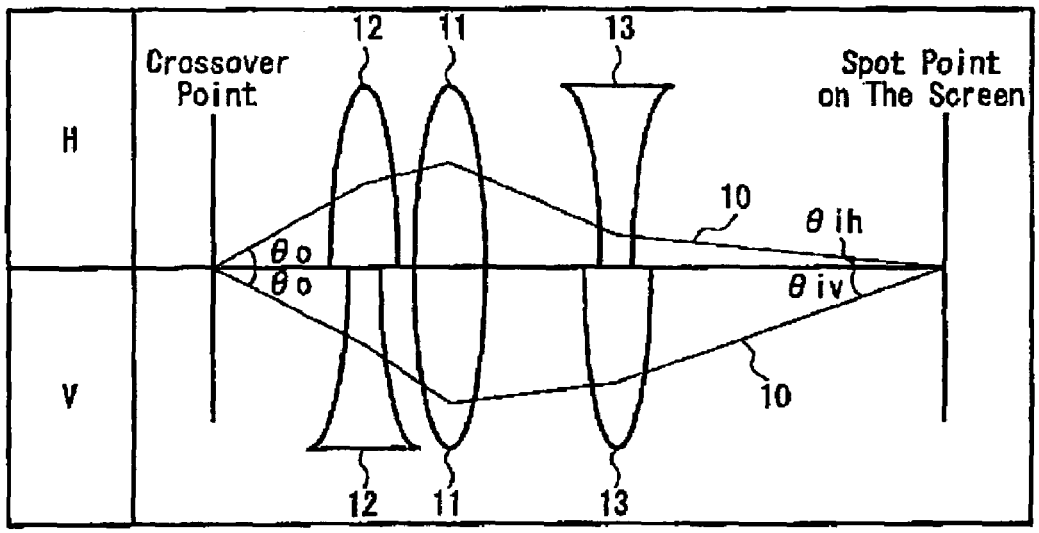
FIG. 6B Prior Art
FIG. 6B shows a model in which the electron lens system in the electron gun in a peripheral portion of the screen is illustrated as in an optical lens and paths of the electron beams passing through this electron lens system, in the color picture tube according to the first conventional technology.
Figure 7A:
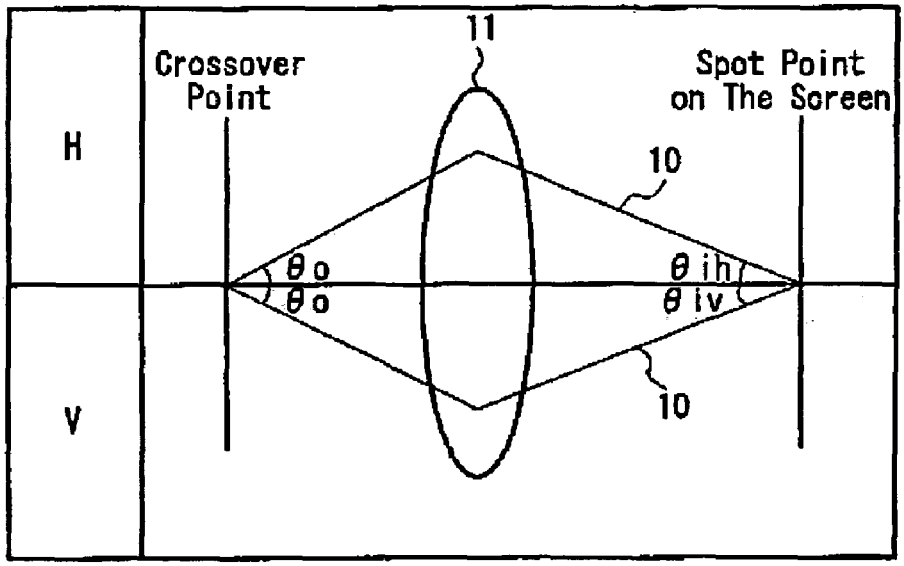
FIG. 7A Prior Art
FIG. 7A shows a model in which an electron lens system in an electron gun in a central portion of a screen is illustrated as in an optical lens and paths of electron beams passing through this electron lens system, in a color picture tube according to a second conventional technology.
Figure 7B:
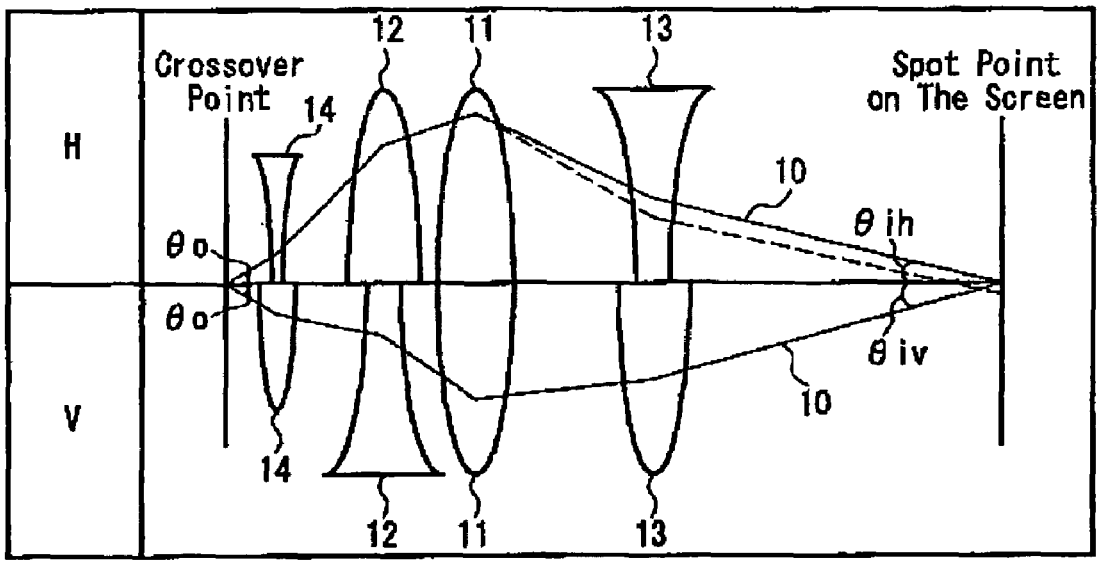
FIG. 7B Prior Art
FIG. 7B shows a model in which the electron lens system in the electron gun in a peripheral portion of the screen is illustrated as in an optical lens and paths of the electron beams passing through this electron lens system, in the color picture tube according to the second conventional technology.

Since an overall configuration of a color picture tube of the present invention is substantially the same as the conventional color picture tube illustrated in FIG. 5, the description thereof will be omitted here.

Figure 2:
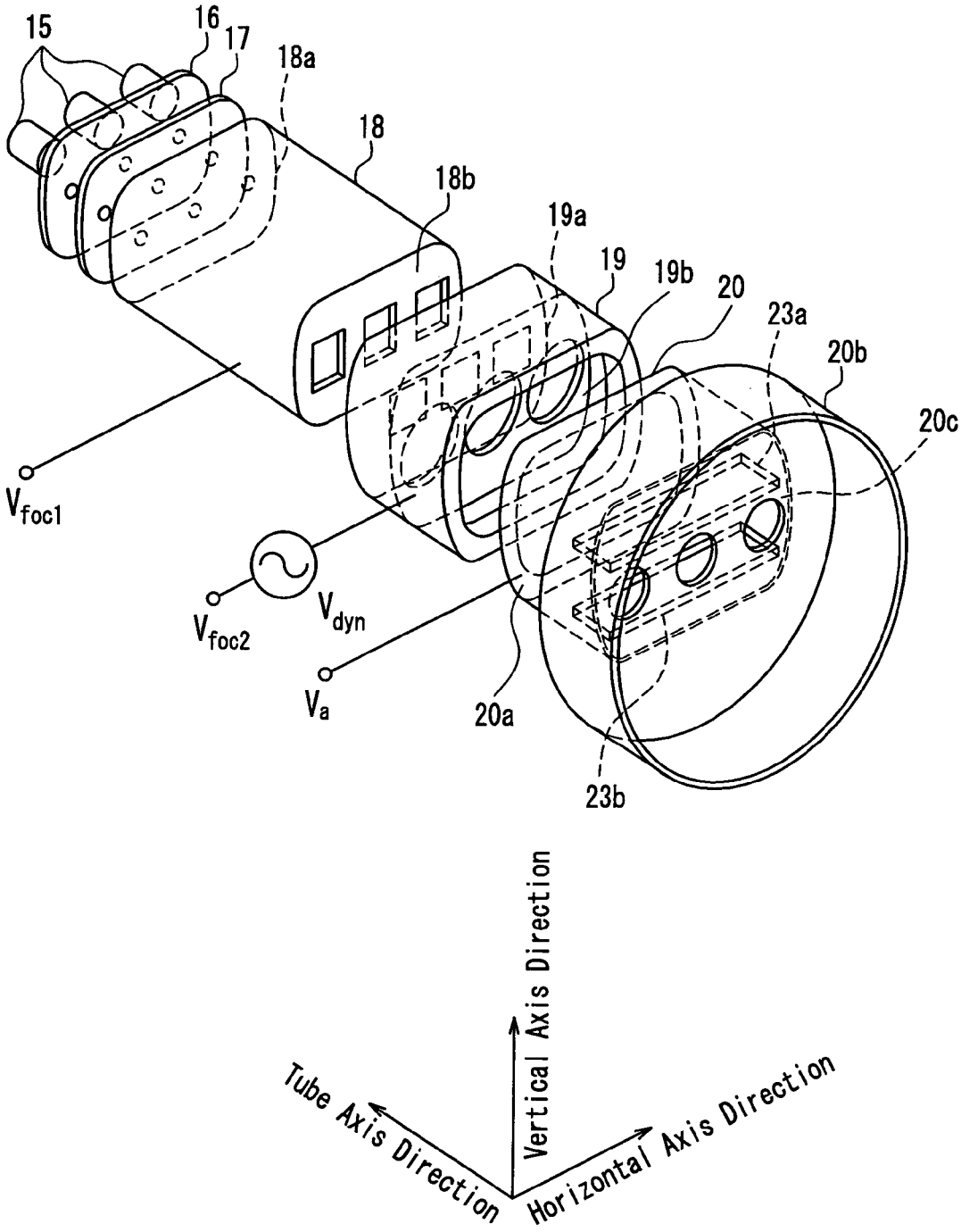
FIG. 2 is a perspective view showing a structure of an electron gun of a color picture tube according to an embodiment of the present invention.

FIG. 2 is a perspective view showing an example of an electron gun of a color picture tube according to an embodiment of the present invention. Three cathodes 15 aligned in a horizontal axis direction of a screen, a plate-like control electrode 16 and a plate-like accelerating electrode 17 that face these cathodes 15, and a tubular first focusing electrode 18, a tubular second focusing electrode 19 and a tubular anode electrode 20 are disposed in this order along a tube axis direction of the color picture tube. Here, three substantially-circular apertures for passing electron beams are formed in the control electrode 16, the accelerating electrode 17 and a surface 18*a* that is provided on an accelerating electrode side of the first focusing electrode 18. The first focusing electrode 18 has another surface 18*b* on a side of the second focusing electrode 19, and this surface 18*b* is provided with three apertures for passing electron beams having a vertical dimension larger than a horizontal dimension (having a vertically-elongated rectangular shape in the present embodiment) corresponding to respective electron beams. The second focusing electrode 19 has a surface 19*a* on a side of the first focusing electrode 18, and this surface 19*a* is provided with three apertures for passing electron beams having a horizontal dimension larger than a vertical dimension (having a horizontally-elongated rectangular shape in the present embodiment) corresponding to respective electron beams. Furthermore, the tubular second focusing electrode 19 has a surface 19*b* within itself, which is provided with three substantially-oval shaped apertures for passing electron beams. The anode electrode 20 includes a horizontally-elongated tubular portion 20*a* and a cylindrical portion 20*b*, and near the border between them, there is a surface 20*c* having three substantially-circular apertures. Moreover, a pair of flat plates 23*a* and 23*b* that sandwich these three apertures from above and below and are each arranged on a virtual plane parallel with the horizontal axis and the tube axis are provided on the side of the cathodes 15 with respect to the surface 20*c*.

Among the electrodes constituted as above, the first focusing electrode 18 is supplied with a first focus voltage Vfoc1, the second focusing electrode 19 is supplied with a voltage obtained by superimposing a dynamic voltage Vdyn on a second focus voltage Vfoc2, and the anode electrode 20 is supplied with a high voltage Va.

At the time of deflection in the central portion of the screen, the dynamic focus voltage Vdyn is zero, resulting in Vfoc2+Vdyn<Vfoc1. On the other hand, at the time of deflection in the peripheral portion of the screen, the dynamic voltage Vdyn increases in keeping with the amount of deflection. Accordingly, as a deflection angle increases, Vfoc2+Vdyn becomes closer to Vfoc1, then achieving Vfoc2+Vdyn=Vfoc1, or even Vfoc2+Vdyn>Vfoc1 in some cases.

Figure 3A:
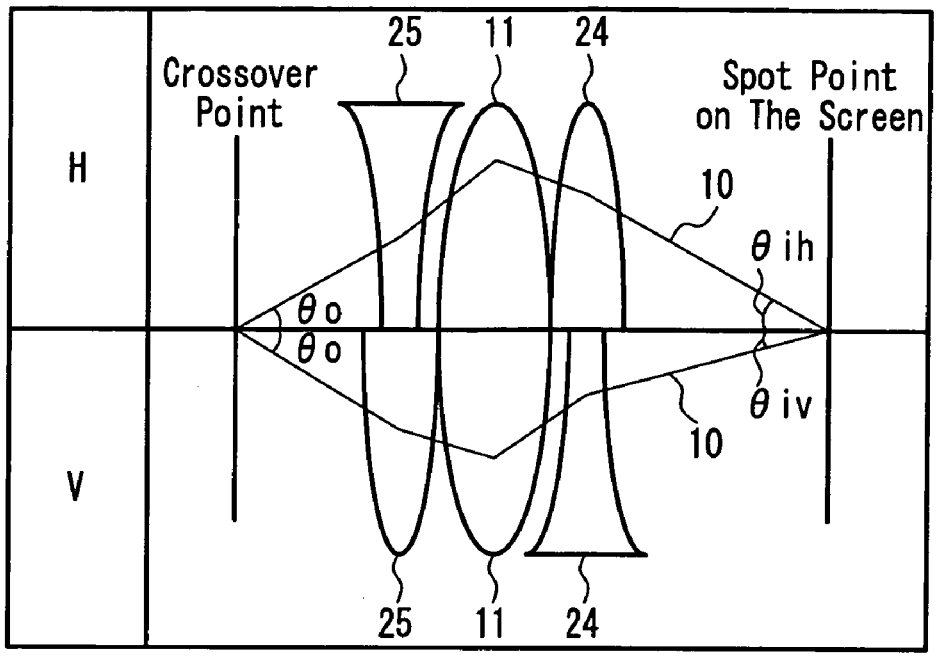
FIG. 3A shows a model in which an electron lens system in the electron gun in a central portion of a screen is illustrated as in an optical lens and paths of electron beams passing through this electron lens system, in the color picture tube according to the embodiment of the present invention.
Figure 3B:
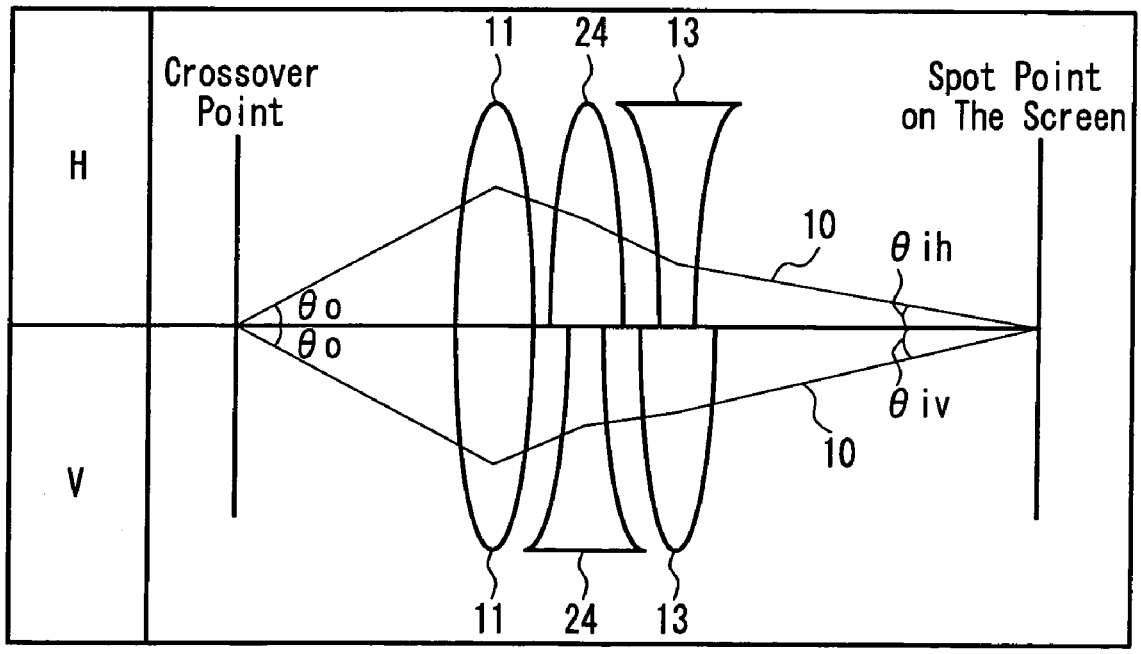
FIG. 3B shows a model in which the electron lens system in the electron gun in a peripheral portion of the screen is illustrated as in an optical lens and paths of the electron beams passing through this electron lens system, in the color picture tube according to the embodiment of the present invention.

FIGS. 3A and 3B show cross-sections, taken along a deflection direction, of a model in which an electron lens system in the electron gun with the above-described configuration is illustrated as in an optical lens and of paths 10 of electron beams passing through this electron lens system. FIG. 3A illustrates the state in the central portion of the screen, while FIG. 3B illustrates that in the peripheral portion of the screen, and in these figures, the upper half shows the horizontal direction (H) and the lower half shows the vertical direction (V). Further, the left end of the figures indicates a crossover point of the electron beams corresponding to an object point of a lens system, while the right end thereof indicates a spot point on the screen corresponding to an image point of the lens system. An outgoing angle from the crossover point is expressed by θo, while an incident angle to the screen is expressed by θi.

In the central portion of the screen, as shown in FIG. 3A, a four-pole lens 24 having a converging effect in the horizontal direction and a diverging effect in the vertical direction is formed at the subsequent stage of the main lens 11 (on the screen side), and a four-pole lens 25 having a diverging effect in the horizontal direction and a converging effect in the vertical direction is formed at the stage immediately before the main lens 11 (on the crossover point side), i.e., between the first focusing electrode and the second focusing electrode. In the peripheral (corner) portion of the screen where the deflection angle is larger, as the dynamic voltage increases, the four-pole lens 25 at the stage immediately before the main lens 11 is weakened and finally lost, so that the lens system is constituted by the main lens 11, the four-pole lens 24 at the stage immediately after the main lens 11 and a deflection magnetic field lens 13 as shown in FIG. 3B.

Because of this lens system, the incident angle θih to the screen in the horizontal direction becomes larger than the incident angle θiv to the screen in the vertical direction in the central portion of the screen. Thus, the lens magnification in the horizontal direction becomes smaller than that in the vertical direction, so that the spot in the central portion of the screen achieves a vertically-elongated shape.

As described above, in a general in-line self-convergence type color picture tube, the spot shape of an electron beam is more likely to be distorted into a horizontally-elongated shape (a shape elongated along the in-line direction) in the peripheral portion of the screen than in the central portion thereof. The present invention is directed to a technology that adopts the above-described configuration so as to bring the spot shape in the central portion of the screen into a vertically-elongated shape whose horizontal dimension is small and vertical dimension is large, thereby alleviating the spot distortion in the peripheral portion of the screen. By bringing the spot shape in the central portion of the screen into a vertically-elongated shape as mentioned above, it becomes easier to make the incident angle θih to the screen in the horizontal direction and the incident angle θiv to the screen in the vertical direction substantially equal in the peripheral (corner) portion of the screen where the deflection angle is large, without being affected by a spherical aberration of the main lens. In addition, since the electron beams do not pass through the edge of the main lens, they are neither affected by the spherical aberration nor over-focused.

Figure 1:
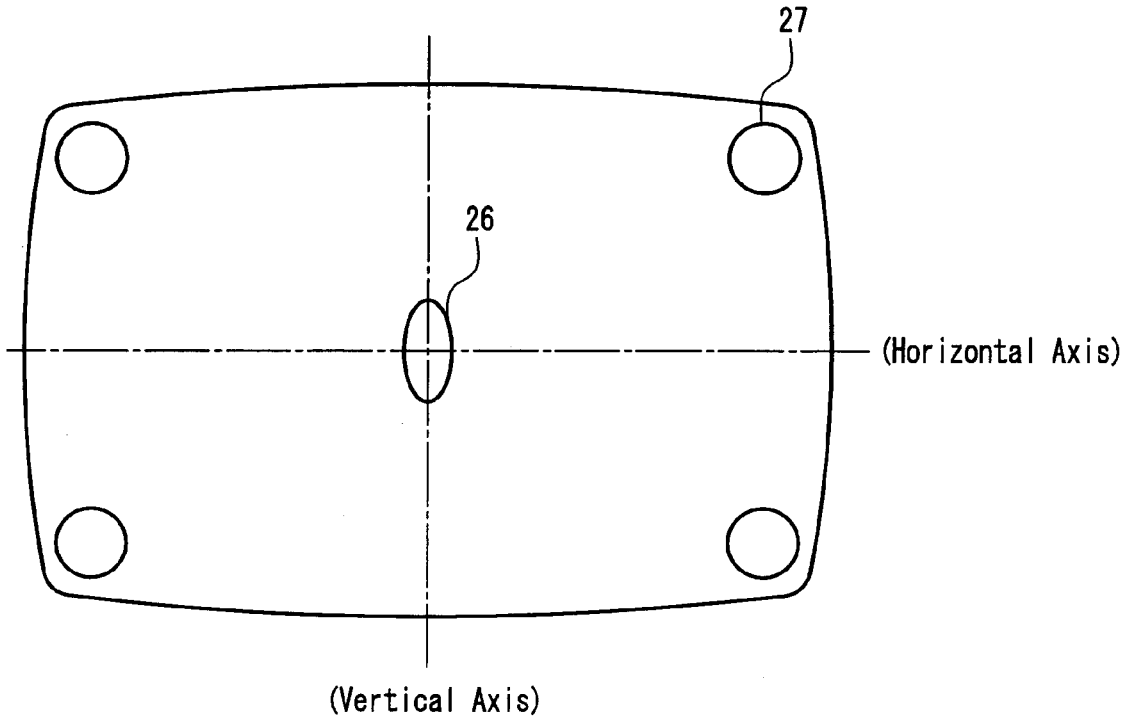
FIG. 1 shows a model of an example of spot shapes on a screen of a color picture tube according to the present invention.

FIG. 1 shows a model of spot shapes on the screen. The shape of a spot 26 in the central portion of the screen is elongated vertically, thereby bringing the shape of a spot 27 in the peripheral (corner) portion of the screen as close as possible to a perfect circle. Thus, it becomes possible both to improve the horizontal resolution in the peripheral portion of the screen and to suppress the generation of moiré.

Figure 4A:
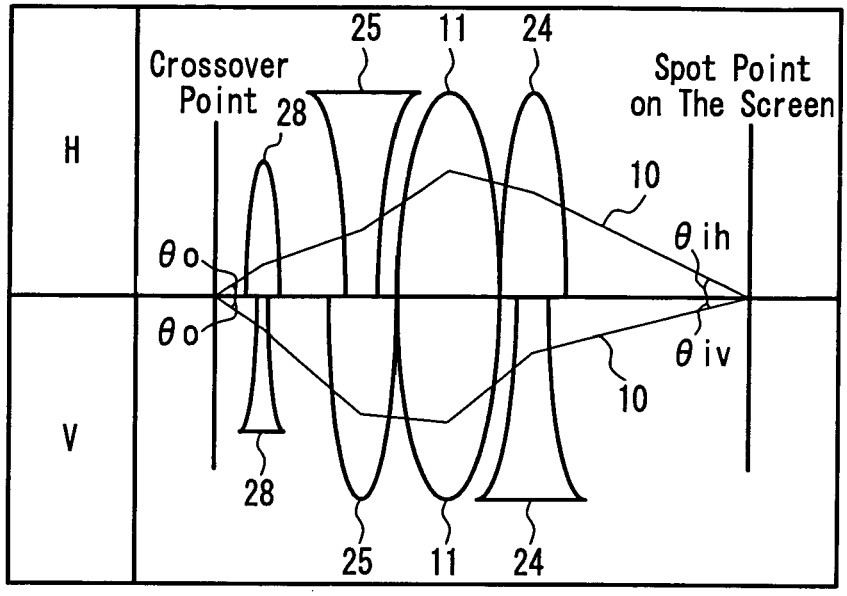
FIG. 4A shows a model in which an election lens system in the electron gun in a central portion of the screen is illustrated as in an optical lens and paths of electron beams passing through this electron lens system, in the color picture tube according to another embodiment of the present invention.
Figure 4B:
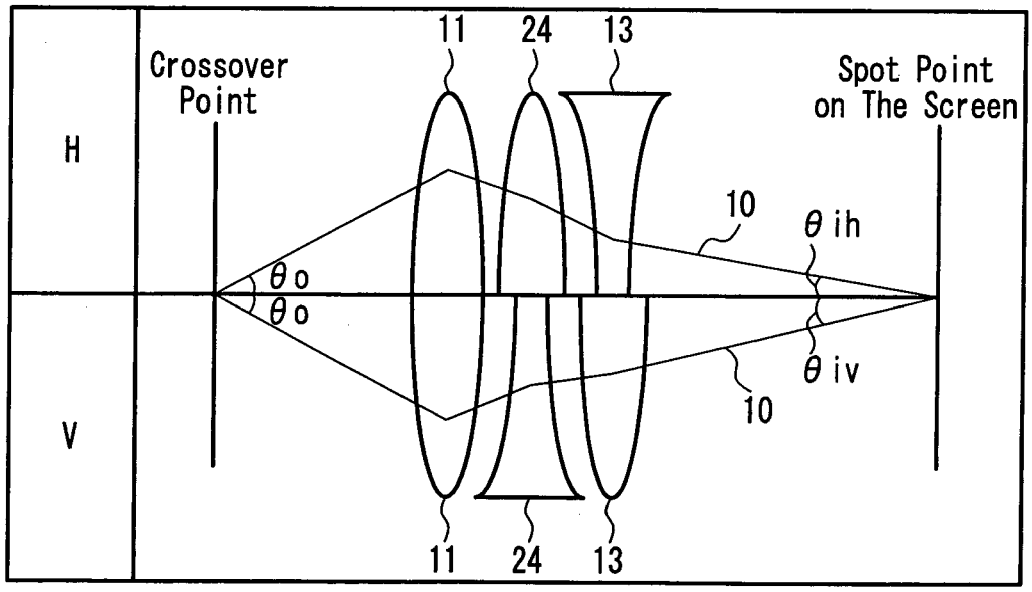
FIG. 4B shows a model in which the electron lens system in the electron gun in a peripheral portion of the screen is illustrated as in an optical lens and paths of the electron beams passing through this electron lens system, in the color picture tube according to another embodiment of the present invention.

In the electron gun described in the above embodiment, a four-pole lens 28 having a converging effect in the horizontal direction and a diverging effect in the vertical direction in the central portion of the screen further may be provided on the side of the crossover point as shown in FIG. 4A. This makes it possible to bring the electron beam passing position in the main lens 11 inward in the horizontal direction and outward in the vertical direction in the central portion of the screen, so that the vertically-elongated spot shape at the center of the screen can be adjusted so as to have at least a lowest allowable vertical resolution. Also, at this time, it is preferable that the four-pole lenses 25 and 28 formed in the central portion of the screen are weakened with an increase in the deflection angle, and lost in the peripheral (corner) portion of the screen (see FIG. 4B).

Furthermore, as a means of carrying out the present invention, an electron beam emitting region of the cathode in the electron gun may have a shape whose horizontal dimension is smaller than its vertical dimension. The spot at the center of the phosphor screen is obtained by mapping the electron beam emitting region of the cathode onto the phosphor screen with electrostatic lenses of the electron gun. Therefore, when the electron beam emitting region of the cathode has a horizontal dimension smaller than its vertical dimension, the spot at the center of the phosphor screen can be formed into a vertically-elongated shape whose horizontal dimension is small and vertical dimension is large. In this case, to be more effective, it is preferable that the horizontal dimension of the apertures for passing electron beams in the control electrode is made smaller than the vertical dimension thereof, that the horizontal thickness of the control electrode is made larger than the vertical thickness thereof, or that the horizontal dimension of the apertures for passing electron beams in the accelerating electrode is made larger than the vertical dimension thereof.

Since electron beams often are aligned along the horizontal direction of the screen in in-line self-convergence type color picture tubes, the embodiment of the present invention has been described by referring the in-line direction as the horizontal direction and the direction perpendicular to the in-line direction as the vertical direction. However, for example, in the case of using an electron gun arranged such that the in-line direction of the electron beams corresponds to the vertical direction of the screen, it is needless to say that the in-line direction is the vertical direction and the direction perpendicular to the in-line direction is the horizontal direction, contrary to the above-described embodiment.

Also, the number and shape of the electrodes constituting the electron gun and the number and shape of the apertures for passing electron beams to be formed in each electrode are not limited to the example of the embodiment described above but may be changed suitably according to an intended purpose.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

The invention claimed is:

1. A color picture tube apparatus with three electron beams arranged in an in-line manner, emitted from an electron gun and being deflected by a self-convergence deflection magnetic field, the color picture tube apparatus comprising:

a main lens portion in the electron gun, the main lens potion includes a main lens that has a focusing effect in the in-line direction and a direction perpendicular thereto and an electrostatic lens that is disposed at a stage immediately after the main lens and has a focusing effect in the in-line direction and a diverging effect in the direction perpendicular thereto; wherein when a spot formed in a central portion of a screen is just in focus, the spot in the central portion of the screen has a dimension along the in-line direction that is different from that along the direction perpendicular to the in-line direction, and the main lens portion further includes a four-pole lens that is disposed at a stage immediately before the main lens at a time of deflection in at least the central portion of the screen and has a diverging effect in the in-line direction and a focusing effect in the direction perpendicular thereto.

2. The color picture tube apparatus according to claim 1, wherein the main lens portion in the electron gun has a lens magnification along the in-line direction that is smaller than that along the direction perpendicular to the in-line direction.

3. The color picture tube apparatus according to claim 1, wherein the electron beams reaching the central portion of the screen have an incident angle to the screen along the in-line direction that is larger than that along the direction perpendicular to the in-line direction.

4. The color picture tube apparatus according to claim 1, wherein when the spot formed in the central portion of the screen is just in focus, the spot in the central portion of the screen has a dimension along the in-line direction that is smaller than that along the direction perpendicular to the in-line direction.

5. A color picture tube apparatus with three electron beams arranged in an in-line manner, emitted from an electron gun and being deflected by a self-convergence deflection magnetic field, the color picture tube apparatus comprising:

a main lens portion in the electron gun, the main lens portion includes a main lens that has a focusing effect in the in-line direction and a direction perpendicular thereto, and an electrostatic lens that is disposed at a stage immediately after the main lens and has a focusing effect in the in-line direction and a diverging effect in the direction perpendicular thereto, and a four-pole lens that is disposed at a stage immediately before the main lens at a time of deflection in at least a central portion of a screen and has a diverging effect in the in-line direction and a focusing effect in the direction perpendicular thereto, wherein as a deflection angle becomes larger, the focusing effect and the diverging effect of the four-pole lens at the stage immediately before the main lens decrease.

6. The color picture tube apparatus according to claim 5, wherein when a spot formed in the central portion of the screen is just in focus, the spot in the central portion of the screen has a dimension along the in-line direction that is smaller than that along the direction perpendicular to the in-line direction.

7. A color picture tube apparatus with three electron beams arranged in an in-line manner, emitted from an electron gun and being deflected by a self-convergence deflection magnetic field, the color picture apparatus comprising:

the electron gun having a first focusing electrode, second focusing electrode and an anode electrode; and a main lens that is formed by the second focusing elcetrode and the anode electrode and has a focusing effect in the in-line direction and a direction perpendicular thereto; and a four-pole lens that is formed by the first focusing electrode and the second focusing electrode and has a diverging effect in the in-line direction and a focusing effect in the direction perpendicular thereto at a time of deflection in a central portion of a screen; and a pair of flat plates that are provided in the anode electrode and are each arranged on a virtual plane parallel with a horizontal axis and a tube axis so as to extend toward the focusing electrode.

8. The color picture tube apparatus according to claim 7, wherein the first focusing electrode is supplied with a first focus voltage Vfoc1 and the second focusing electrode is supplied with a second focus voltage Vfoc2 that is lower than the first focus voltage Vfoc1 at the time of deflection in the central portion of the screen.

9. The color picture tube apparatus according to claim 7, wherein when a spot formed in the central portion of the screen is just in focus, the spot in the central portion of the screen has a dimension along the in-line direction That is smaller than that along the direction perpendicular to the in-line direction.

* * * * *